US007086990B2

(12) United States Patent
Chuang et al.

(10) Patent No.: US 7,086,990 B2
(45) Date of Patent: Aug. 8, 2006

(54) DATA TRANSMISSION DEVICE OF WRIST EXERCISER

(76) Inventors: Yun Yu Chuang, 4F, No. 16, Alley 15, Lane 82, Da Yong Street, San Chong City, Taipei (TW); Ming Hung Lin, 2F, No. 24, Lane 178, Li Shyng Road Section 1, San Chong City, Taipei (TW); Pei Sung Chuang, No. 20, Alley 13, Lane 122, Tzu-Chiang Road, Dan Shui Town, Taipei (TW)

( * ) Notice: Subject to any disclaimer, the term of this patent is extended or adjusted under 35 U.S.C. 154(b) by 248 days.

(21) Appl. No.: 10/714,646

(22) Filed: Nov. 18, 2003

(65) Prior Publication Data

US 2005/0107218 A1 May 19, 2005

(51) Int. Cl.
*A63B 5/00* (2006.01)

(52) U.S. Cl. ..... 482/8; 482/44; 482/45; 601/33

(58) Field of Classification Search ..... 482/1, 482/2, 8, 4, 5, 44, 45, 49, 50, 92, 106, 108, 482/135–137, 902; 601/23, 33, 40
See application file for complete search history.

(56) References Cited

U.S. PATENT DOCUMENTS

| | | | | |
|---|---|---|---|---|
| 5,800,311 | A * | 9/1998 | Chuang | 482/44 |
| 6,527,675 | B1 * | 3/2003 | Yu | 482/44 |
| 6,770,012 | B1 * | 8/2004 | Kuo | 482/44 |

* cited by examiner

*Primary Examiner*—Glenn E. Richman
(74) *Attorney, Agent, or Firm*—Rosenberg, Klein & Lee

(57) ABSTRACT

A data transmission device is mounted to a wrist exerciser for detecting the rotational speed of a rotor inside the wrist exerciser and generating and transmitting exercising data associated with the rotational speed from the wrist exerciser to an external device. The data transmission device includes a transmitter unit coupled to a casing of the wrist exerciser and having a sensor for detecting the rotational speed of the rotor and issuing a detection signal, and a processing circuit receiving and processing the detection signal to provide an output of the exercising data, including counts of rotation and the rotational speed. A transmission cable has a first end connectable with the output of the processing circuit to receive the exercising data and a second end engageable with a counterpart device of the external device for forwarding the exercising data to the external device. Examples of the external devices include a personal computer, a personal digital assistant and a mobile phone having built-in memory for storage of the exercising data and a built in display for displaying the exercising data.

11 Claims, 8 Drawing Sheets

DATA TRANSMISSION DEVICE OF WRIST EXERCISER

BACKGROUND OF THE INVENTION

1. Field of the Invention

The present invention generally relates to a wrist exerciser that is held by a palm of a user and having an internal rotor that is caused to rotate by the user exercising his or her wrist muscles, and in particular to a data transmission device that is coupled to the wrist exerciser to detect and processes data associated with the rotation of the rotor and transmits the data to an external device, such as a computer, for analysis and display.

2. The Related Art

A wrist exerciser is employed to exercise and rehabilitate wrist-related muscles of a user. Apparent therapeutic result can be obtained in the user for rehabilitation purposes. Examples of the wrist exercisers are shown in Taiwan Utility Model No. 135058 and U.S. Pat. No. 6,623,405, both disclose wrist exercises in which wrist related muscles are well exercised by simply rotating the wrist exerciser with the wrist.

The conventional wrist exercisers, however, do not provide means for detecting and displaying rotation related data of the wrist exerciser, such as counts of turns that the internal rotor rotates, rotational speed of the rotor, and time of playing the wrist exerciser, to facilitate understanding and monitoring of personal exercise by the user.

Wrist exercisers having sensing means to detect the rotational speed of the rotor are known. However, the detection is displayed by a liquid crystal display or a light emitting diode base display, which is bulky, often causing interference with the operation of the wrist exerciser by the user. In addition, replacement of the display as a whole is required, if the display is broken or malfunctions. This causes additional expenses and troubles.

Further, no data storage is provided in the conventional wrist exerciser. Thus, the operation condition of the wrist exerciser or the exercising condition of the user cannot be record and stored day by day for future analysis.

Thus, it is desired to have a wrist exerciser that overcomes the drawbacks in the prior art.

SUMMARY OF THE INVENTION

Thus, a primary objective of the present invention is to provide a wrist exerciser having a data transmission device for detecting and transmitting data related to the use of the exerciser to an external storage.

Another object of the present invention is to provide a wrist exerciser comprising a data transmission device engageable with an external data processing and storage device, such as a personal computer, a mobile phone and a personal digital assistant (PDA) for further processing and storage.

A further object of the present invention is to provide a wrist exerciser comprising a data transmission device that transmits data related to the use of the exerciser to an external display for selective display of the exercising condition.

To achieve the above objective, in accordance with the present invention, there is provided a wrist exerciser comprising a data transmission device mounted to the wrist exerciser for detecting the rotational speed of a rotor inside the wrist exerciser and generating and transmitting exercising data associated with the rotational speed from the wrist exerciser to an external device. The data transmission device comprises a transmitter unit coupled to a casing of the wrist exerciser and having a sensor for detecting the rotational speed of the rotor and issuing a detection signal, and a processing circuit receiving and processing the detection signal to provide an output of the exercising data, including counts of rotation and the rotational speed. A transmission cable has a first end connectable with the output of the processing circuit to receive the exercising data and a second end engageable with a counterpart device of the external device for forwarding the exercising data to the external device. Examples of the external devices include a personal computer, a personal digital assistant and a mobile phone having built-in memory for storage of the exercising data and a built in display for displaying the exercising data.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
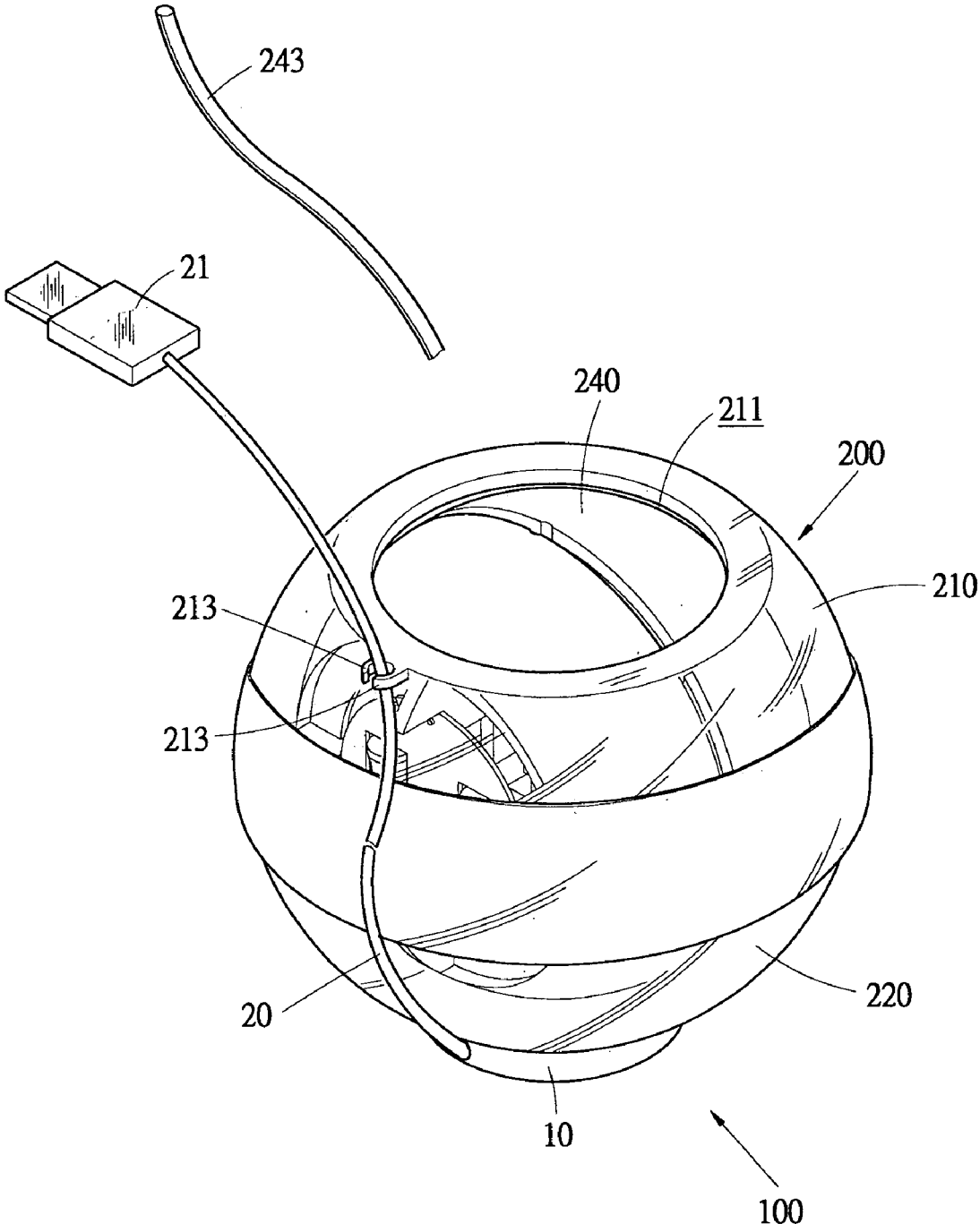
FIG. 1 is a perspective view of a wrist exerciser constructed in accordance with a first embodiment of the present invention.
Figure 2:
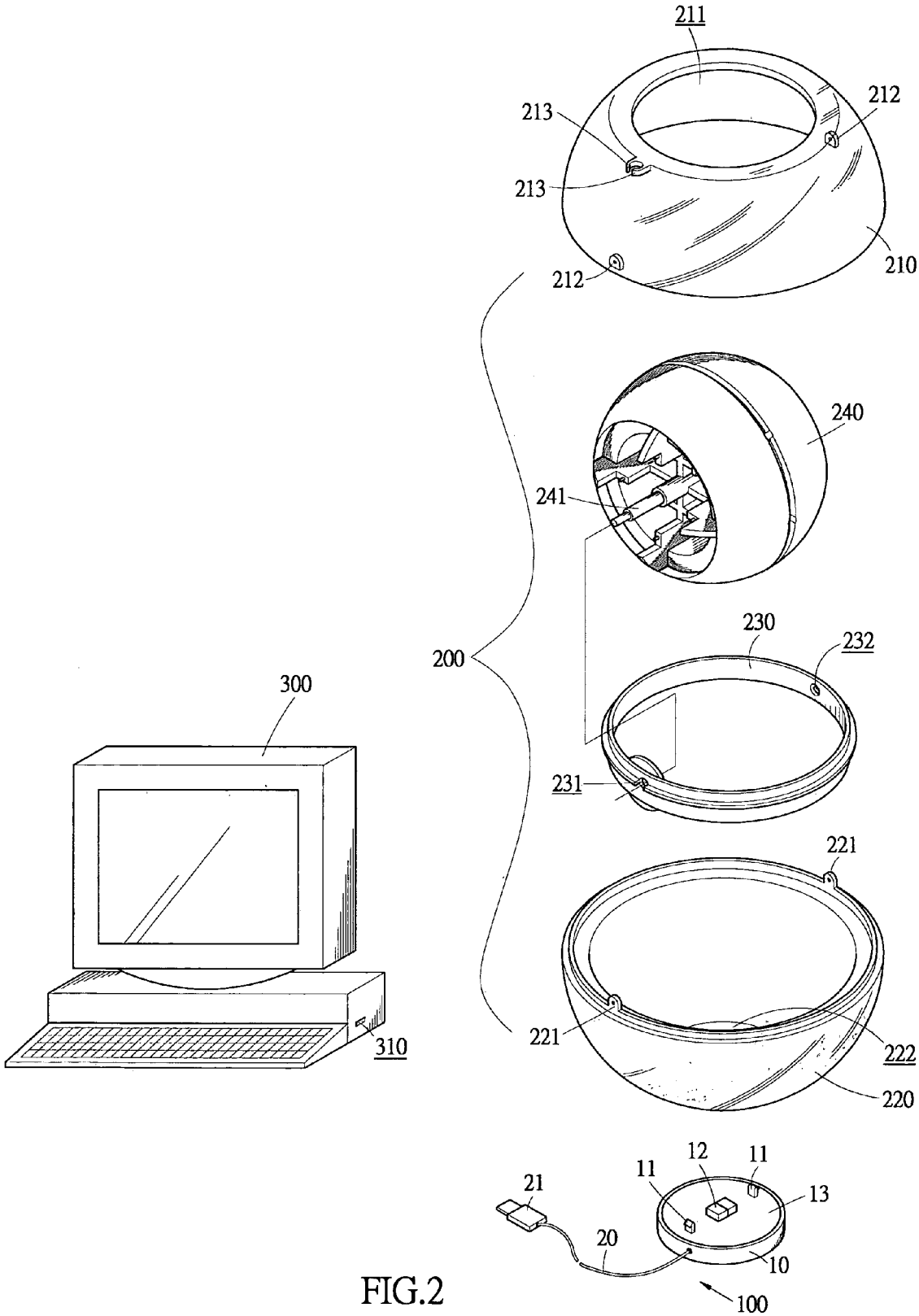
FIG. 2 is an exploded view of the wrist exerciser of the first embodiment in accordance with the present invention and a personal computer to which data related to the operation condition of the wrist exerciser are transmitted by means of a data transmission device incorporated in the wrist exerciser.

With reference to the drawings and in particular to FIGS. 1 and 2, a wrist exerciser constructed in accordance with the present invention, generally designated with reference numeral 200 to which a data transmission device, designated with reference numeral 100 is attached. The wrist exerciser 200 comprises a casing, substantially spherical in shape, comprised of an upper casing member 210 and a lower casing member 220, both being substantially hemispherical and mounted to each other to form the spherical casing.

The upper and lower casing members 210, 220 can be secured together by any known means. For example and as illustrated in FIG. 2, the lower casing member 220 form two lugs 221 each defining a through hole (not labeled). Corresponding to the lugs 221 and the through holes thereof, the upper casing member 210 form coupling portions 212 that overlap the lugs 221. The coupling portions 212 define through holes (not labeled) substantially aligning the holes of the lugs 221 for receiving fasteners (not shown). Alternatively, the coupling portions 212 may be formed to snap fit the lugs 221 and the fasteners are no longer needed. Other means, such as adhesives, can be used alternatively to secure the upper and lower casing members 210, 220 together.

Two spaced, resilient arms 213 are formed on an outside surface of the upper casing member 210 to provide a resilient clamping means, which will be further discussed. Preferably, a substantially circular space (not labeled) is formed between the arms 213.

Inside the casing, a retention ring 230, substantially corresponding to a great circle of the sphere of the casing, is arranged and fixed by being partially interposed between the upper and lower casing members 210, 220. The retention ring 230 defines diametrically opposite and coaxially aligned holes 231, 232. An internal rotor 240, also having a substantially spherical configuration, has two coaxial shafts 241 extending from opposite sides of the rotor 240 and rotatably received in the holes 231, 232 of the retention ring 230. Thus, the rotor 240 is maintained rotatable inside the casing and substantially between the upper and lower casing members 210, 220 by means of the rotatable joint between the retention ring 230 and the shafts 241 of the rotor 240.

The upper casing member 210 forms an opening 211 substantially opposite to the lower casing member 220. A wire 243 extends into the casing through the opening 211. The rotor 240 forms a circumferential groove 242 substantially corresponding to a great circle of the rotor 240. The wire 243 is manually wound around the groove 242 of rotor 240. By forcibly pulling and thus unwinding the wire 243 from the rotor 240, the friction force between the rotor 240 and the wire 243 drives an initial rotation of the rotor 240 inside the casing. Thereafter, by rotating the wrist exerciser 200 with a palm, the rotation of the rotor 240 can be maintained and lasting for a long time.

The lower casing member 220 also defines an opening 222, which is, preferably, substantially opposite to the opening 211 of the upper casing member 210, but not necessary to be so. The data transmission device 100 comprises a transmitter unit 10 having a disc like shape received and fixed in the lower opening 222 and a transmission cable 20 having an proximal end connected to or connectable to the transmitter unit 10.

The transmitter unit 10 can be attached to the lower casing member 220 by any known means, such as a pair of resilient arms 11 having barbed ends opposite to each other. The barbs of the arms 11 may resiliently engage a flange (not shown) formed inside the lower casing member 220 to attach the transmitter unit 10 to the lower casing member 220.

Figure 3:
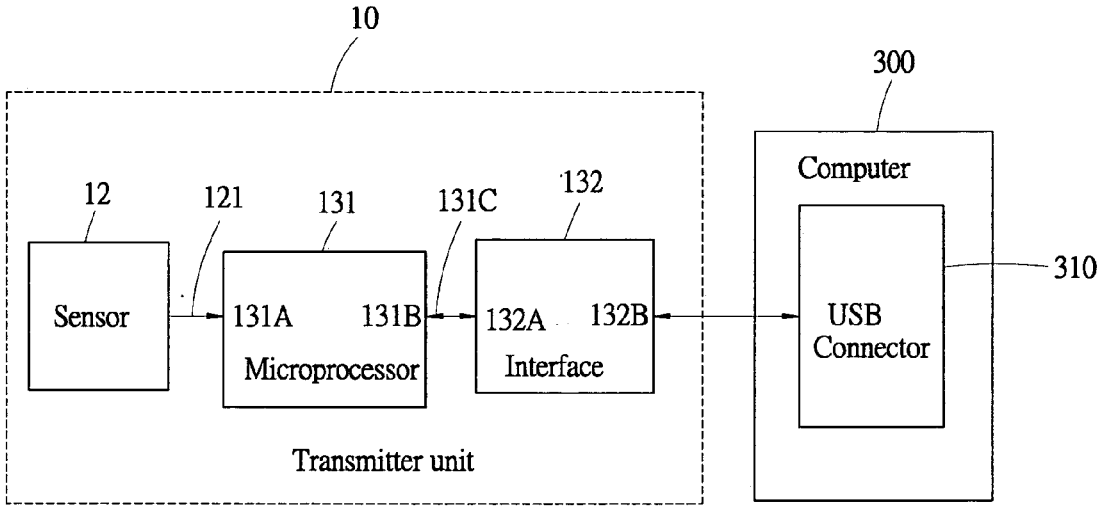
FIG. 3 is a block diagram of a control circuit of the data transmission device of the wrist exerciser of the present invention.

Also referring to FIG. 3, the transmitter unit 10 comprises a control circuit 13, preferably made in the form of a printed circuit board, facing the rotor 240 through the lower opening 222. The control circuit 13 comprises sensor means 12, which can be of any known and suitable sensors, mounted on the circuit board and opposing the rotor 240 to detect the number of turns of rotation of the rotor 240 and to issue a first electrical signal or a detection signal 121 in associated with the number of turns. An example of the sensor means 12 includes photo-electrical detection devices. Other devices having similar function can be alternatively employed.

The control circuit 13 comprises a microprocessor 131 having an input port 131A for receiving the first electrical signal 121. The first electrical signal 121 that carries the information associated with the number of turns of the rotor 240 is processed by the microprocessor 131 based on algorithm that is made or preloaded or selectively loaded in the microprocessor 131 to provide an actual number of turns, and in addition, the rotational speed of the rotor 240. The processing result of the microprocessor 131, which stands for the operation condition of the wrist exerciser 200 or exercising condition performed by a user playing the wrist exerciser 200, is then supplied through an output port 131B of the microprocessor 131, as a second electrical signal 131C.

The control circuit 13 further comprises an interface circuit 132 having an input 132A that receives the second electrical signal 131C from the microprocessor 131 for further processing of the second electrical signal 131C for transmission purposes and the result signal is output through an output port 132B of the interface circuit 132. The interface circuit 132 can be configured based on any data transmission standard currently available, such as universal serial bus (USB) interface that is employed in the embodiment illustrated. However, other data transmission interface, such as the well know RS232 interface, can be adopted alternatively and additionally.

The transmission cable 20 of which the proximal end is connected to the transmitter unit 10 and in electrical communication with the output port 132B of the interface circuit 132 has a remote end forming an electrical connector 21 corresponding to the type of interface circuit 132 and engageable with a counterpart device, such as socket connector 310, formed in an external device, such as a personal computer 300, for transmission of data related to exercising condition to the external device. In the embodiment illustrated, the interface circuit 132 is a USB interface and thus the electrical connector 21 comprises a USB connector and the socket 310 of the computer 300 is a USB socket connector. The computer 300 receives and stores the exercising data and performs analysis or other processing on the data. The analysis or result of processing by the computer 300 can be displayed on a monitor of the computer 300.

The transmission cable 20 is selectively fit into the circular space between the arms 213 and fixed therein by the arms 213. This may eliminate possible interference caused by the cable 20 during the operation of the wrist exerciser 200.

Due to the USB based connection between the computer 300 and the data transmission device 100, power required to drive the data transmission device 100 can be provided by the computer 300 through the USB connection.

Figure 4:
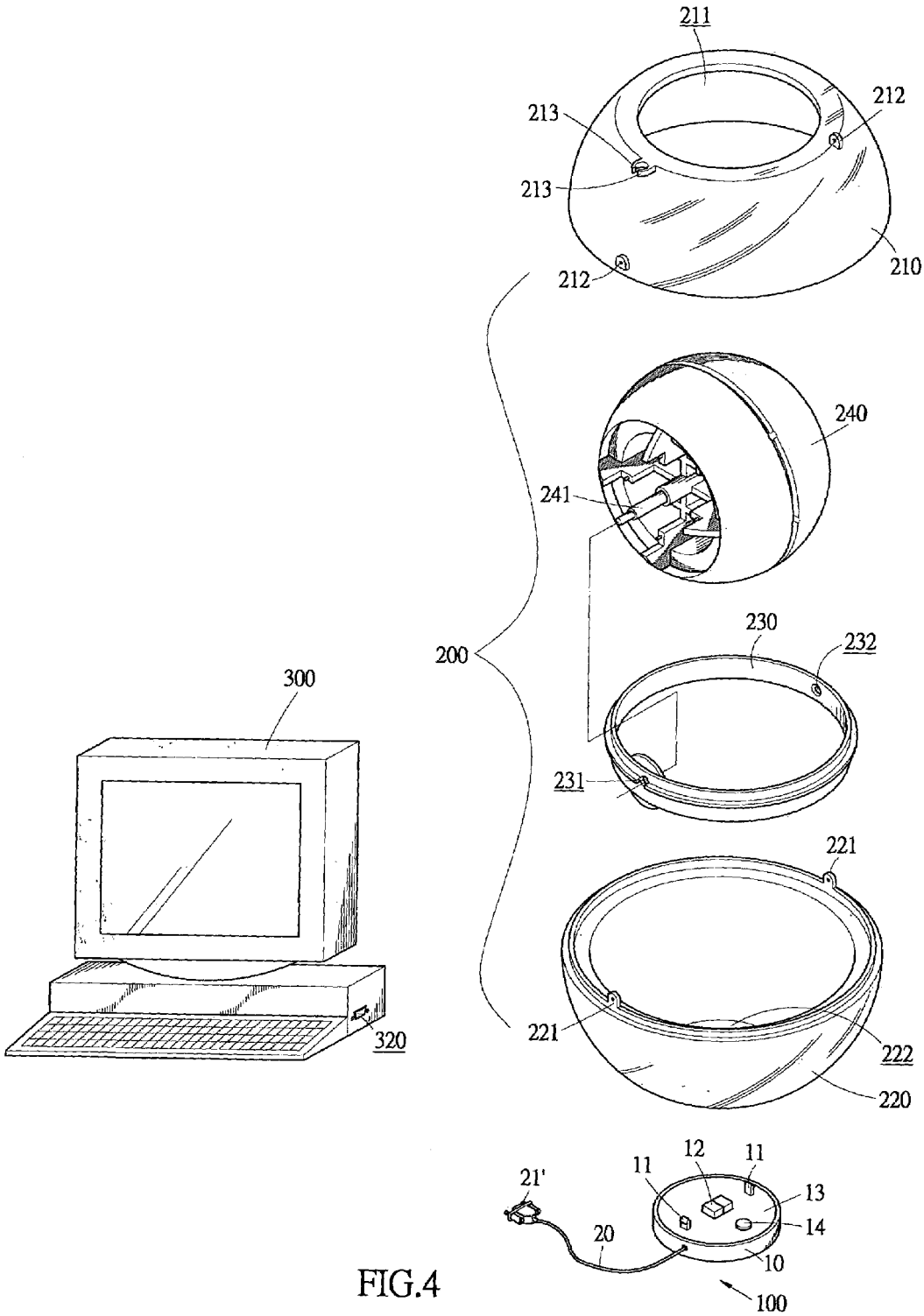
FIG. 4 is an exploded view of a wrist exerciser constructed in accordance with a second embodiment of the present invention and a personal computer to which data related to the operation condition of the wrist exerciser are transmitted by means of a data transmission device incorporated in the wrist exerciser.

Other interface, such as RS232 interface, can be employed to replace the USB interface discussed above for transmission of data to the computer 300. FIG. 4 shows a second embodiment of the wrist exerciser 200 in accordance with the present invention, in which the interface circuit 132 comprises an RS232 interface. The transmission cable 20 having the proximal end connected to the RS232 interface circuit 132 has a remote end forming an RS232 connector 21' for selectively engaging a counterpart RS232 connector 310 formed in the computer 300. In this case, power is not supplied from the computer 300 to the data transmission device 100 and instead, a built-in power source comprised of an electrical cell 14 is provided on the circuit board 13.

Figure 5:
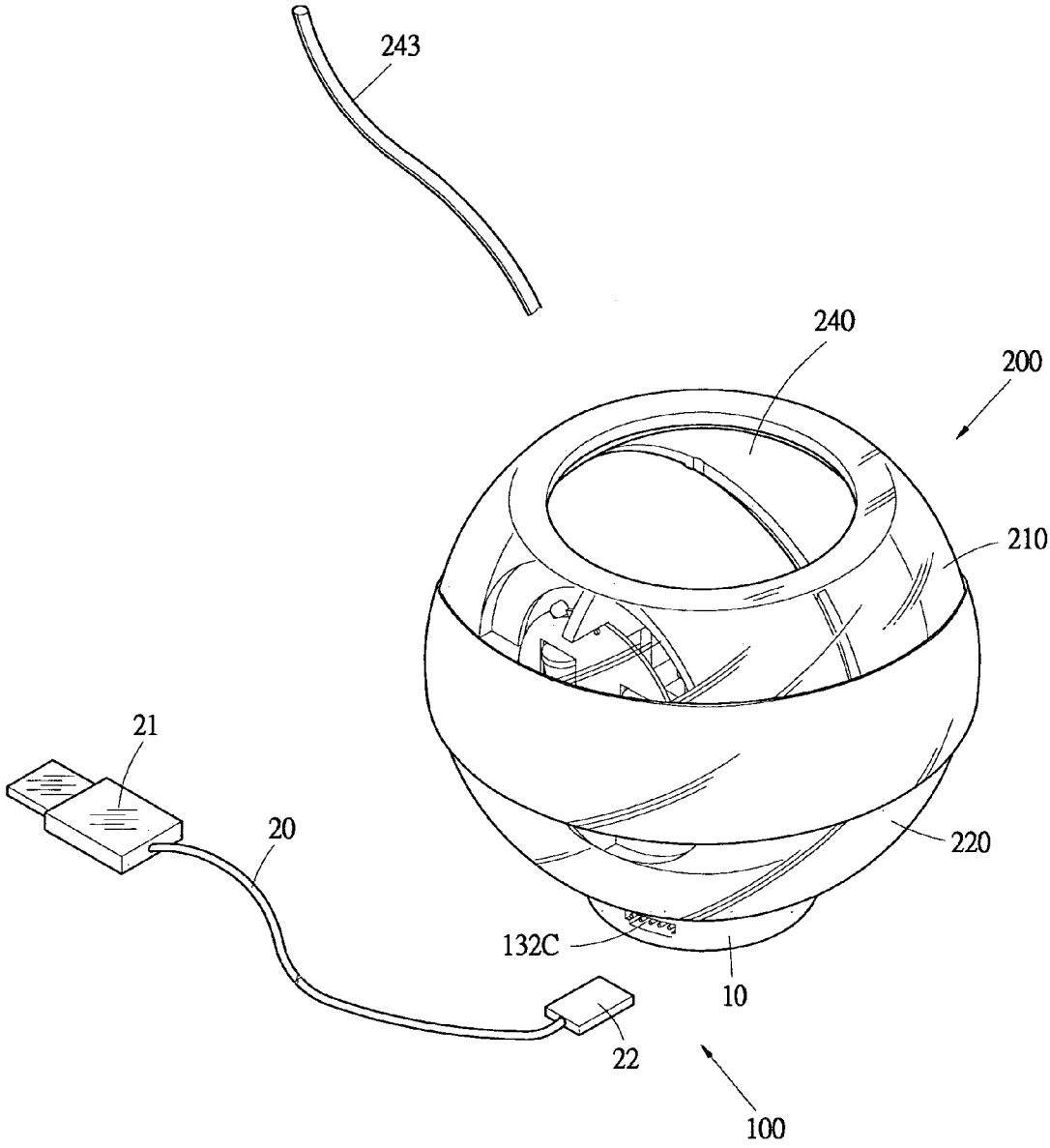
FIG. 5 is a perspective view of a wrist exerciser constructed in accordance with a third embodiment of the present invention.
Figure 6:
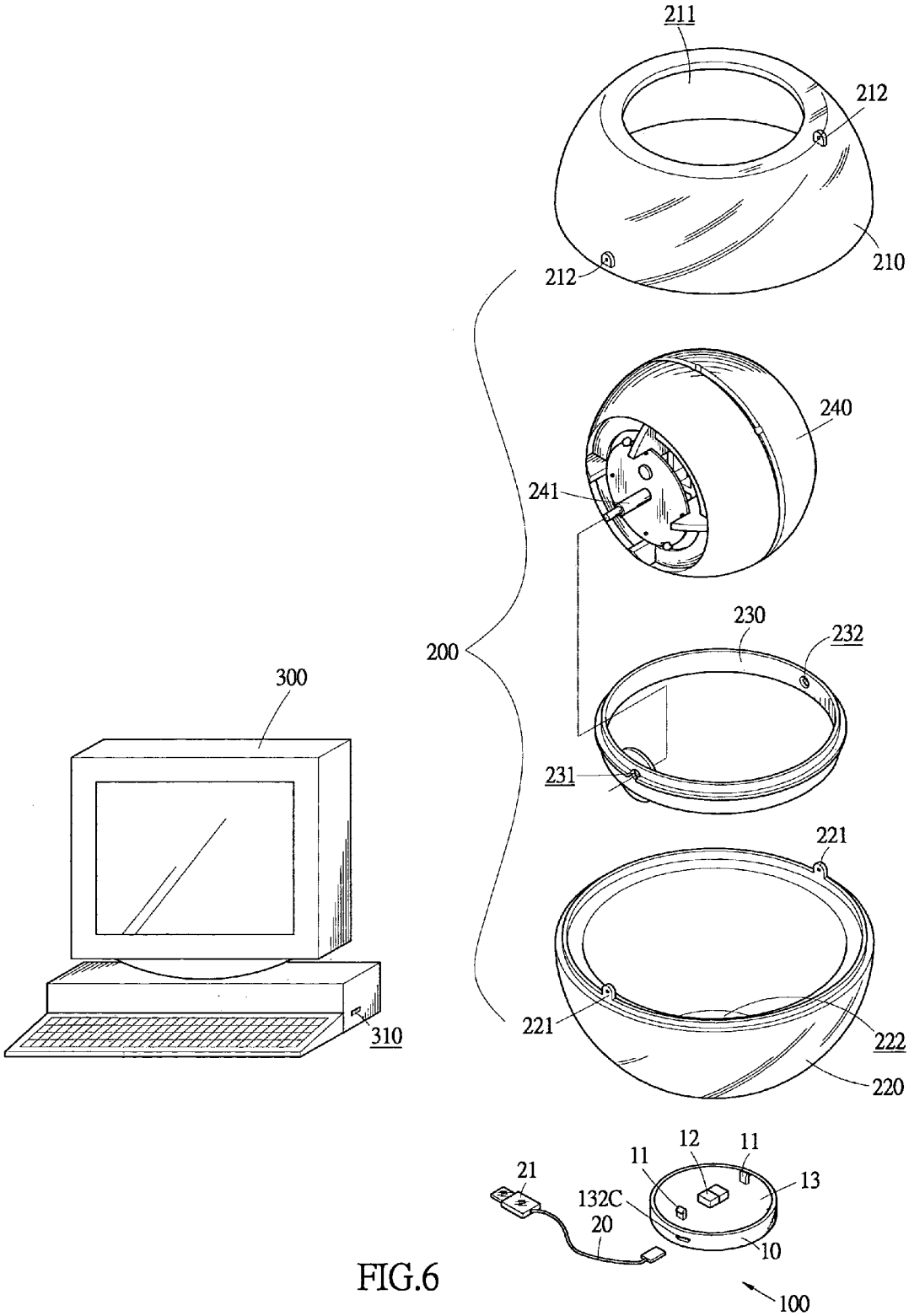
FIG. 6 is an exploded view of the wrist exerciser of the third embodiment in accordance with the present invention and a personal computer to which data related to the operation condition of the wrist exerciser are transmitted by means of a data transmission device incorporated in the wrist exerciser.

Although the transmission cable 20 is shown previously having a proximal end connected to the data transmission device 100, the proximal end of the transmission cable 20 can be made releasably engageable with the data transmission device 100 of which an example is illustrated in FIGS. 5 and 6 showing a third embodiment of the wrist exerciser in accordance with the present invention. In the embodiment illustrated in FIGS. 5 and 6, the proximal end of the transmission cable 20 forms an electrical connector 22, which is a mini-USB connector in the embodiment illustrated, engageable with a counterpart mini-USB connector 132C formed in and electrically connected to the output port 132B of the interface circuit 132. This allows the cable 20 to be selectively removed from the wrist exerciser 200 to avoid undesired interference with the operation of the wrist exerciser 200 and for purposes of packing and transportation.

Figure 7:
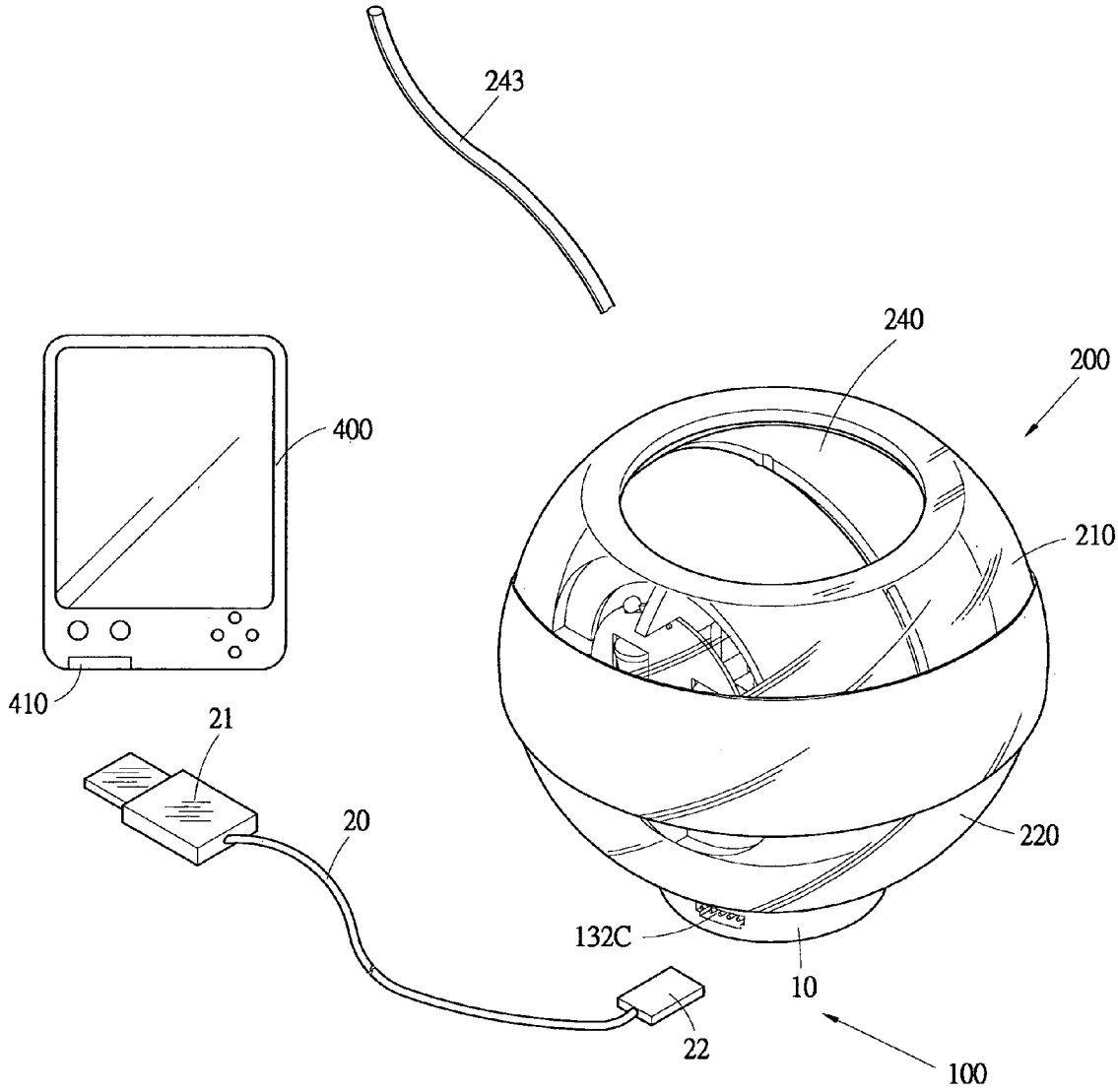
FIG. 7 is similar to FIG. 6 but showing the data transmission device of the wrist exerciser is connected to a personal digital assistant (PDA)

Besides a personal computer 300 discussed in the previous examples, the exercising data obtained from the wrist exerciser 200 can be transmitted to and stored in other external electronic processing and storage device. In FIG. 7 of the attached drawings, a personal digital assistant (PDA) 400 having an electrical connector 410 engageable with the remote end connector 21 of the cable 20 serves as the external device to which the exercising data is transmitted and stored therein. The data can then be displayed on a built-in display of the PDA 400.

Figure 8:
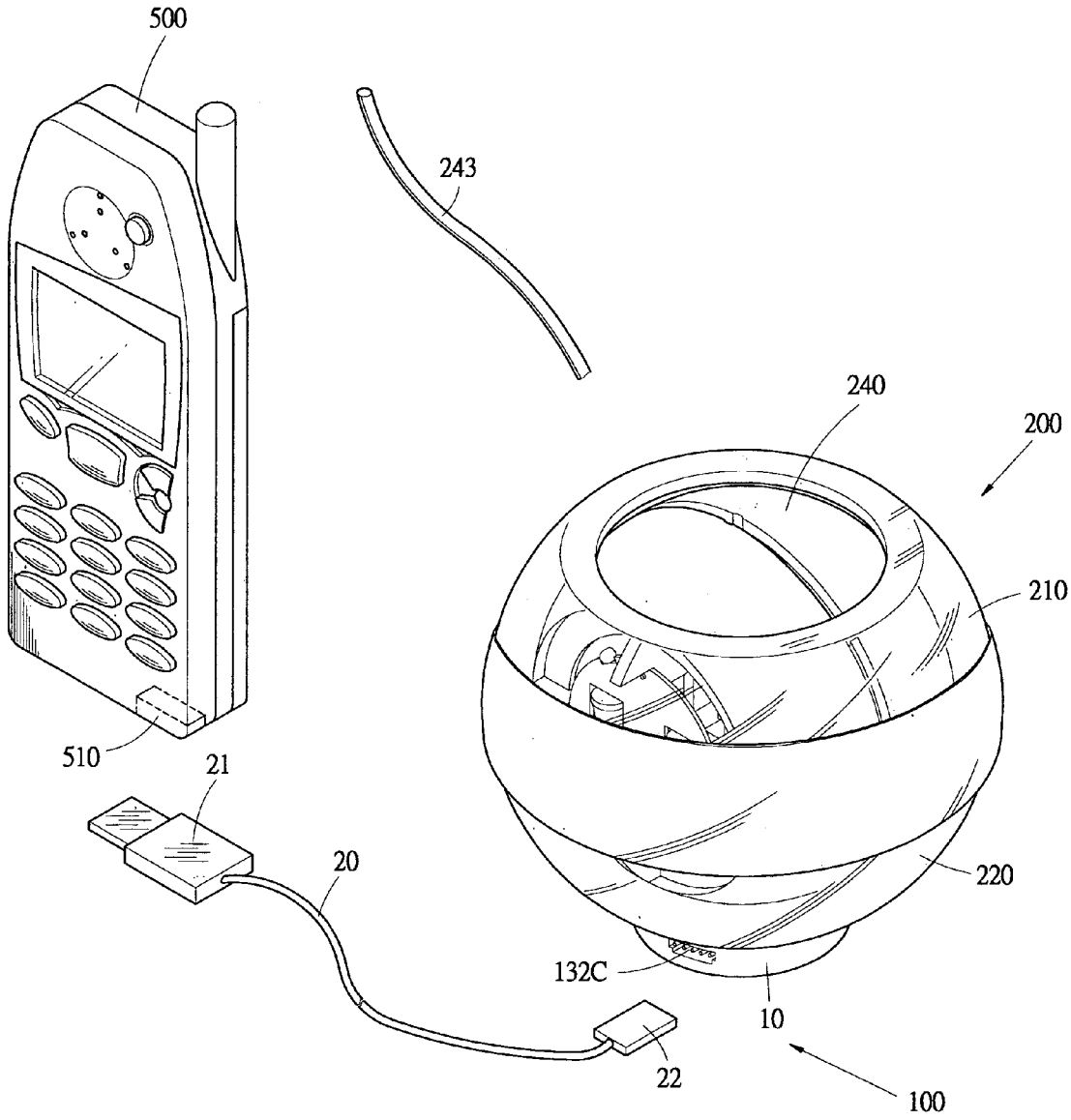
FIG. 8 is similar to FIG. 6 but showing the data transmission device of the wrist exerciser is connected to a mobile phone.

FIG. 8 shows another example of the wrist exerciser in accordance with the present invention in which the remote end connector 21 of the transmission cable 20 is in connection with a counterpart connector 510 formed on a mobile phone 500 whereby the exercising data can be stored in memory of and displayed by the mobile phone 500 and can be further transmitted through the mobile phone 500.

The present invention provides a wrist exerciser that is capable to transmit and store exercising data in external devices, such as personal computer, PDA and mobile phone, with a simple and low cost construction. The exercising data can then be displayed by means of the built-in display device of the external device. Thus, no display is required on the wrist exerciser 200 itself. Drawback associated with size and complication of additional display and storage of the wrist exerciser 200 is effectively eliminated.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A data transmission device adapted to mount to a wrist exerciser for transmitting exercising data from the wrist exerciser to an external device, the data transmission device comprising:

a transmitter unit coupled to a casing of the wrist exerciser and comprising a sensor for detecting rotational speed of a rotor rotatably supported inside the casing of the wrist exerciser and issuing a detection signal, and a processing circuit receiving and processing the detection signal to provide an output of the exercising data which includes rotational speed; and a transmission cable having a first end connectable with the output of the processing circuit to receive the exercising data and a second end engageable with a counterpart device of the external device for forwarding the exercising data to the external device.

2. The data transmission device as claimed in claim 1, wherein the sensor comprises a photo-electrical detection device.

3. The data transmission device as claimed in claim 1, wherein the casing of the wrist exerciser forms an opening having a flange and wherein the transmitter unit forms a pair of resilient arms having barbed ends engageable with the flange to couple the transmitter unit to the casing.

4. The data transmission device as claimed in claim 1, wherein the processing circuit comprises:

a microprocessor having a first input connected to the sensor to receive the detection signal and a first output that supplies an intermediate signal; and interface means having a second input connected to the first output for receiving and processing the intermediate signal and generating the exercising data at a second output of the interface means.

5. The data transmission device as claimed in claim 4, wherein the interface means comprises a universal serial bus (USB) based interface.

6. The data transmission device as claimed in claim 4, wherein the interface means comprises an RS232 based interface.

7. The data transmission device as claimed in claim 4, wherein the second output of the interface means forms an electrical connector engageable with a mating electrical connector formed on the first end of the transmission cable.

8. The data transmission device as claimed in claim 7, wherein the electrical connector comprises a mini-USB connector.

9. The data transmission device as claimed in claim 1, wherein the second end of the transmission cable forms a USB connector.

10. The data transmission device as claimed in claim 1, wherein the first end of the transmission cable forms an electrical connector.

11. The data transmission device as claimed in claim 10, wherein the electrical connector comprises a mini-USB connector.

* * * * *